United States Patent [19]

Ford

[11] 3,982,742

[45] Sept. 28, 1976

[54] MEDICAL STIRRUPS

[76] Inventor: John L. Ford, 4651 E. Palomino Road, Phoenix, Ariz. 85018

[22] Filed: Nov. 17, 1975

[21] Appl. No.: 632,480

[52] U.S. Cl. ..... 269/328
[51] Int. Cl.[2] ..... A61G 13/00
[58] Field of Search ..... 269/328; 5/327 R; 247/385, 423, 433; 128/94

[56] References Cited

UNITED STATES PATENTS

| | | | |
|---|---|---|---|
| 1,546,813 | 7/1925 | Thomsen | 269/328 |
| 2,792,266 | 5/1957 | Waters | 269/328 |
| 3,355,163 | 11/1967 | Leinassar | 269/328 |
| 3,823,933 | 7/1974 | Mueller et al. | 269/328 |
| 3,907,270 | 9/1975 | Ezzo | 269/328 |

*Primary Examiner*—Al Lawrence Smith
*Assistant Examiner*—Robert C. Watson
*Attorney, Agent, or Firm*—Don J. Flickinger

[57] ABSTRACT

A pair of elongate flexible curvilinear shafts are adapted at one end thereof to be secured to a surgical operating table. Detachably securable to the free end of each shaft is a pair of mutually arcuate straps which receive and hold a foot to support a patient's legs during certain surgical procedures. Manually operative detent means carried by the free end of the shaft and operatively associated with the straps provide for selective restraint or release of the foot.

5 Claims, 11 Drawing Figures

MEDICAL STIRRUPS

This invention relates to medical and surgical equipment supplies.

More particularly the present invention concerns support and restraint means for use during certain medical and surgical procedures.

In a further aspect the invention concerns means for holding the legs of a patient in a predetermined position upon a medical table.

Certain medical and surgical procedures require that a designated part of the patient's anatomy is held in a specified position. Exemplary is a general category which includes orthopedic preps, gynecological surgery, laporoscopy, abdomin-perineal procedures and other similar techniques which are particularly unique to surgical patients. Herein, the patient lies in the supine position upon an operating table with the legs supported in a generally elevated and spread position. For maximum medical efficiency each particular procedure requires that the legs be restrained in a generally similar yet distinctively different position.

The generally accepted prior art devices for accomplishing the foregoing purposes is an elongate metallic shaft, having a U-shaped bend at one end thereof. The shaft is sized and shaped at the lower end thereof to be clamped in a swivel mechanism a pair of which are generally secured to the end of the surgical table along either side thereof. When secured to the table the shaft assumes a generally upright position with the end of the U-shaped bend pointed downwardly with a hook depending therefrom. Suspended from the hook is a foot restraint which comprises a continuous belt generally of heavy woven cloth which passes through two D-rings. The hook includes safety catch means for accidental dislodgement of the D-rings. The shaft may also include a telescoping arrangement for limited vertical adjustment. Such devices are commonly referred to as stirrups.

Due to the various types of medical and surgical procedures which are accommodated by stirrups and the probable time span during which a patient may be so supported numerous inherent limitations associated with the conventional prior art devices are immediately apparent. An exceedingly serious problem susceptibility of the patient to leg burns during laporoscopic procedures if a more expedient electric path is determined through the patient's contact with the stirrup than the standard grounding path. Temporary but nevertheless extremely painful damage is often incurred to the sciatic nerve. This is a result of the common tendency of medical attendants to lounge against the patient's thigh which develops considerable pressure against the rigid shaft during the period of a procedure which may last from 30 minutes to 3 hours. It is also noted that the rigid shafts confine the patient in an unforgiving position which may induce undue strain since a minor shift in position may materially assist the patient's comfort and would not interfere with the medical procedure.

Initiating and terminating methods utilizing conventional prior art stirrups has been the source of much consternation of medical personnel. It is desirable for maximum patient comfort and to minimize post-procedural complications that the patient's legs be elevated and lowered simultaneously. Due to the antiquated and complicated foot restraints associated with the prior art proper leg manipulation required the coordinated effort of two attendants, one handling each foot. Further, properly securing a patient's foot in such a restraint is a slow and laborious process.

It would be highly advantageous, therefore, to provide an improved medical device of the type commonly referred to as stirrups for supporting a patient's legs during certain medical and surgical procedures.

Accordingly, it is a principal object of the present invention to provide medical leg support means of the stirrup type which materially enhance the safety and comfort of the patient.

Another object of the present invention is the provision of leg support means which are more expediently useable by medical personnel.

Still another object of the present invention is the provision of medical stirrups which will hold a patient's legs in selectively different anatomically correct positions to accommodate various procedures.

Yet another object of the invention is to provide a simplified foot restraint means whereby the patient's feet may be manipulated simultaneously by one attendant.

Yet still another object of the present invention is the provision of medical stirrups which are non-conductive to alleviate the possibility of surgical burns.

A further object of the instant invention is the provision of leg support devices which substantially eliminate the possibility of painful pressure against the patient's legs.

And a further object of the present invention is the provision of medical stirrups which can accommodate minor comfort adjustments by the patient.

And a further object of the invention is to provide a device of the above type which is simple and economical to manufacture, comparatively lightweight and relatively durable.

Briefly, to achieve the desired objectives of the present invention first provided is an elongate shaft having first and second ends. The first end is sized and shaped to be secured to a medical table by means commonly provided for that purpose. Connection receiving means are integral with the second end of the shaft. Next provided are foot receiving means in the form of an elongate flexible strap having connection receiving means proximate either end thereof which are detachably engageable with the connection receiving means associated with the shafts. A second elongate flexible strap is secured at either end thereof to the first strap.

In a further embodiment, the center lines of the two straps bear a generally arcuate relationship for receiving the heel of the patient's foot when the foot receiving means is suspended from the shaft by a single connection means. Subsequent engagement of the other connection means with the shaft properly restrains the patient's foot. Detent means associated with the connection receiving means operatively and selectively retain the connection means of the foot receiving means. Further the shaft is fabricated of a non-conductive material and is curvilinear to avoid the patient's leg.

The previously stated and further and more specific objects and advantages of the present invention will become readily apparent to those skilled in the art from the following detailed description of the preferred embodiments thereof taken in conjunction with the drawings in which.

Figure 1:
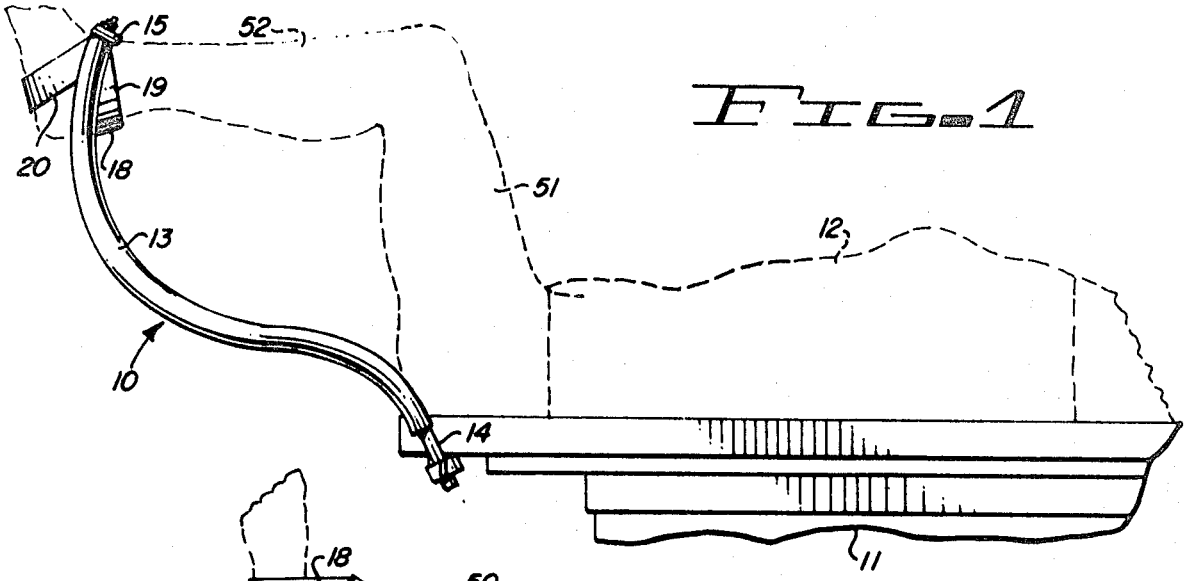
FIG. 1 is an elevational view of a leg support or stirrup constructed in accordance with the teachings of the present invention as it would appear when secured to a medical table and supporting a patient in the orthopedic prep position; the medical table being shown in partial view, the patient being shown in broken outline.

Turning now to the drawings in which the same reference numerals indicate corresponding elements throughout the several views attention is first directed to FIG. 1 which shows a stirrup generally designated by the reference character 10 constructed in accordance with the teachings of the present invention as it would appear when used in combination with a medical table generally designated by the reference character 11 to support a patient indicated by the dashed outline 12 in the orthopedic prep position. The term medical table as used herein refers generally to operating tables, examination tables and other similar devices used for specific medical and surgical procedures. Stirrup 10 includes an elongate shaft 13 having first and second ends 14 and 15, respectively.

First end 14 of elongate shaft 13 is sized and shaped to be secured to means normally integral with medical tables for the purpose of detachably securing various accessory items. Second end 15 is adapted for detachable connection of foot receiving means here generally designated by the reference character 18 and including first and second strap members 19 and 20. Elongate shaft 13 may be fabricated from various metallic or non-metallic materials, however, for reasons which will become apparent presently it is preferred that shaft 13 be formed of a non-conductive moderately flexible material. A material which is consistent with the objectives of the instant invention is nylon.

Figure 7:
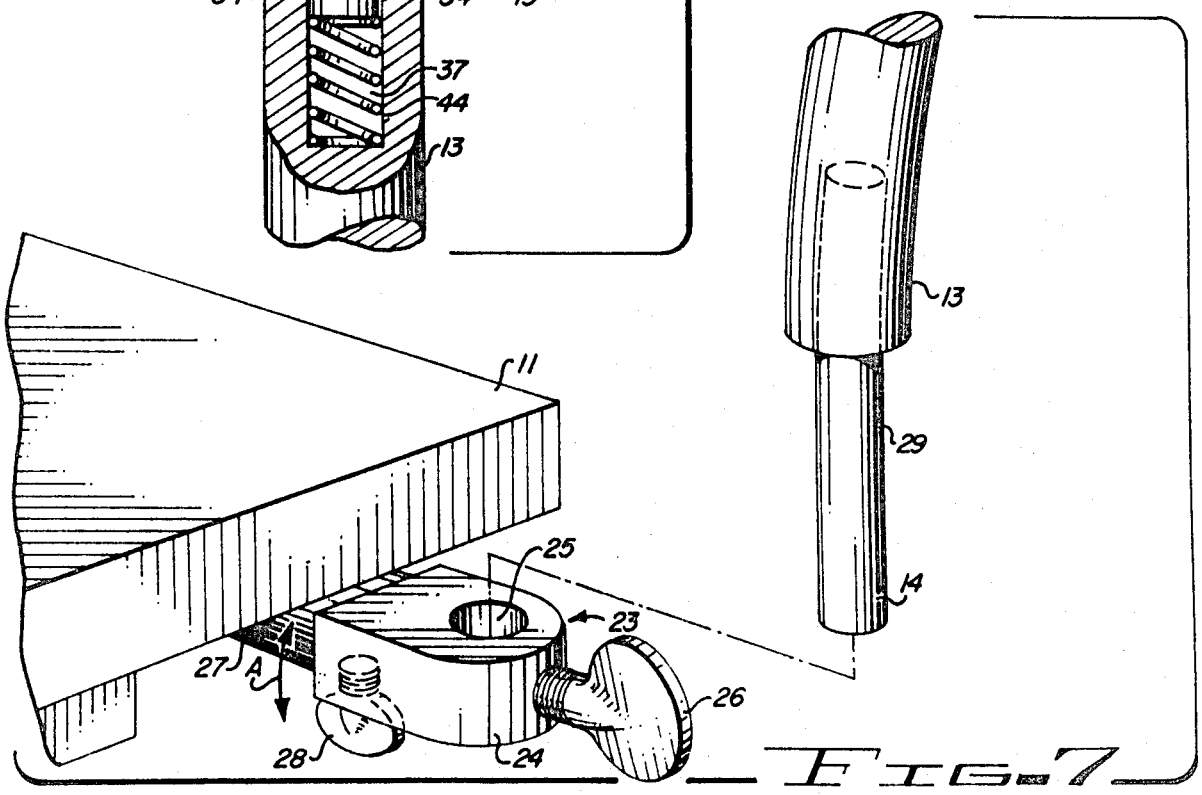
FIG. 7 is a partial perspective view illustrating the attachment of the support shaft to a medical table.

Medical table 11, as specifically seen in FIG. 7, is conventionally supplied by the manufacturer with integral accessory attachment means 23. Being graphically representative of such devices, accessory attachment means 23 includes block member 24 having an aperture therethrough for receiving the accessory which is then secured as by thumb screw 26. Shaft 27 is rigidly affixed to medical table 11 and extends therefrom for pivotal attachment of block member 24 which may be rotated as designated by the double ended arrow A. Block member 24 is locked in the desired position by a second locking means here illustrated as a second thumb screw 28. First end 14 of elongate shaft 13 is sized and shaped to be received within aperture 25. In accordance with the instant embodiment stub shaft 29 is embedded in elongate shaft 13 and projects therefrom to be received within aperture 25. To resist wear especially deformation from locking screw 26 stub shaft 29 is preferably a ferrous metal and may further include surface hardening such as chrome plating.

Figure 5:
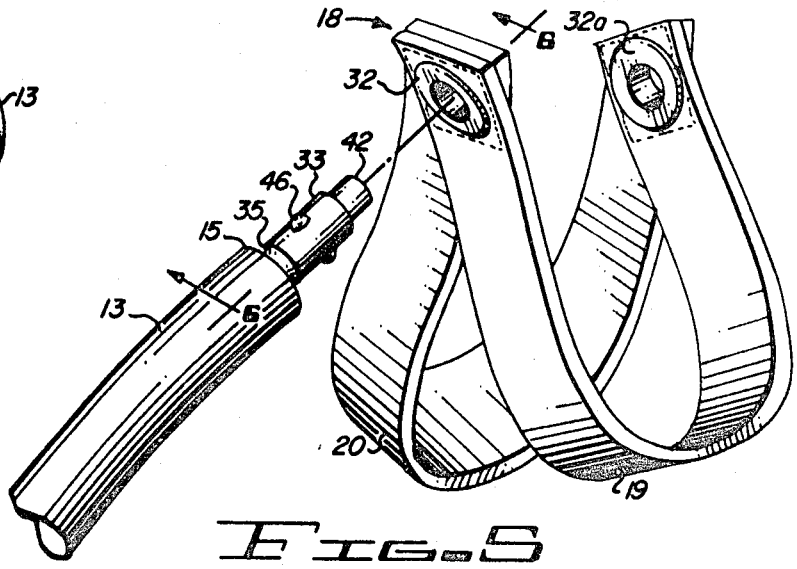
FIG. 5 is a perspective view of foot receiving means and the end of a support shaft to which it is detachably secured in accordance with a preferred embodiment of the instant invention.
Figure 6:
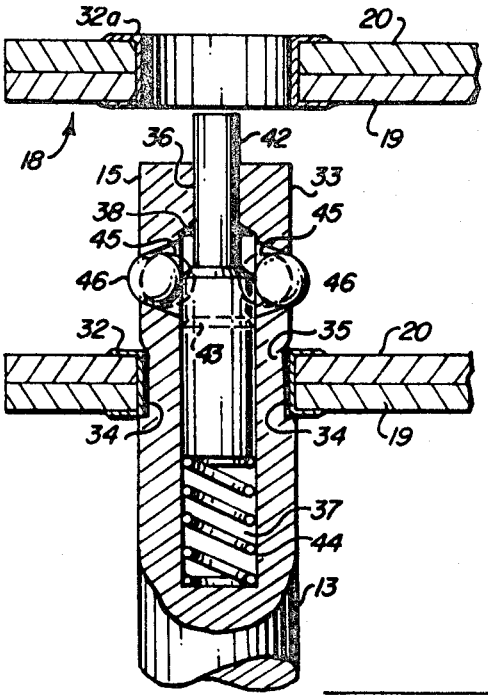
FIG. 6 is a vertical sectional view taken along the line 6—6 of FIG. 5 and further illustrating the connection means between the foot receiving means and the support shaft of the instant invention.

Second end 15 of elongate shaft 13 is best illustrated in detail in FIGS. 5 and 6. Foot receiving means 18, as will be hereinafter described in greater detail, is provided with connection means in the form of eyes 32 and 32A at either end thereof. Strap members 19 and 20 are fabricated from a durable, flexible material, such as webbing or duck cloth, and connection means 32 and 32A are standard metallic reinforcing eyes as is well known in the upholstery and tent making trades. Connection receiving means integral with second end 15 includes reduced diameter terminal section 33 the reduced size of which creates annular shoulder 34. In accordance with a preferred embodiment of the invention eye 32 has an internal diameter of the same size as 32A and terminal section 33 is sized to closely receive the eyes thereover. An annular groove 35 in terminal section 33 adjacent shoulder 34 provides relief to insure that eye 32 will pivot freely about the connection receiving means. A pilot bore concentric with the longitudinal axis of shaft 13 extends inwardly from the end of terminal section 33 to blind counter bore 37. Internal annular shoulder 38 extends between pilot bore 36 and counter bore 37.

Plunger 41 is slidably disposed within counter bore 37 and has stem 42 extending therefrom through pilot bore 36. Tapered annular shoulder 43 extends between stem 42 and plunger 41. Coiled compression spring 44 resides in the bottom of counter bore 37 and normally urges tapered annular shoulder 43 of plunger 41 against internal annular shoulder 38 of counter bore 37. Spaced conical apertures 45 extend radially from counter bore 37 through terminal section 33. Preferably 3 conical apertures are equally spaced about the diameter of terminal section 33, however, it is immediately apparent that other arrangements are functionally equivalent. A ball 46 is captive within each conical aperture 45.

In accordance with the foregoing arrangement one of the connection means is considered semi-captive upon the connection receiving means. That is, eyelet 32 generally resides within groove 35 and requires a deliberate action to be removed from terminal section 33. This prohibits accidental separation of foot receiving means 18 from elongate shaft 13. When stem 42 is depressed against spring 44 balls 46 are prevented to retract inwardly against the reduced diameter of stem 44. Eye 32A can then be passed over terminal section 33 to a position adjacent eye 32. When pressure on stem 42 is released spring 44 urges plunger 41 toward the end of shaft 13 during which movement tapered shoulder 43 cams balls 46 outwardly. Thereafter, balls 46 are held in a partly projecting position against the enlarged diameter of plunger 41.

Figure 2:
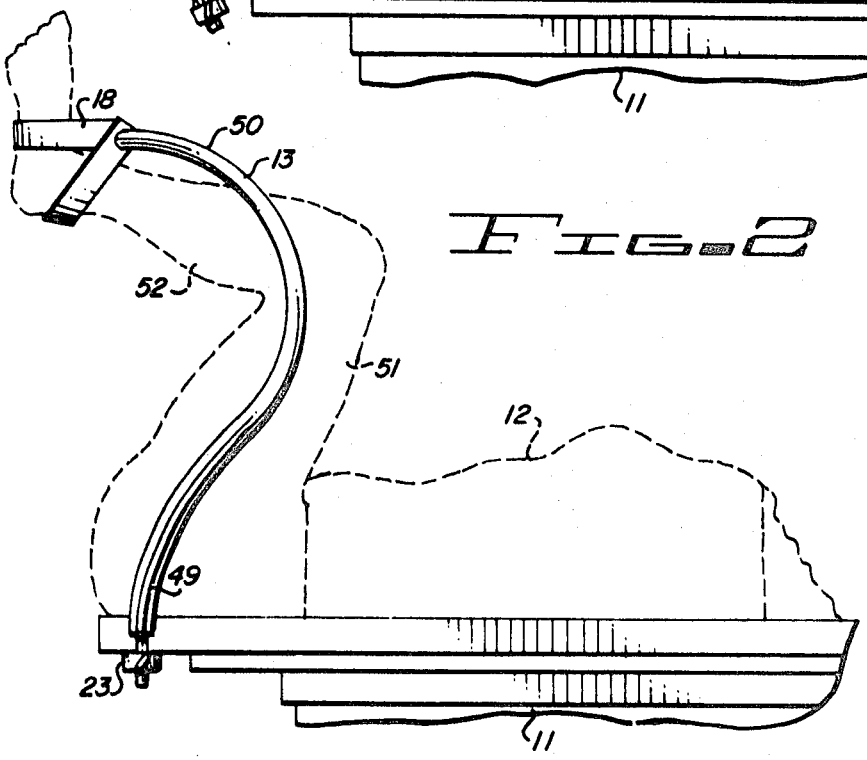
FIG. 2 shows an elevational view similar to the view of FIG. 1 except having the stirrups adjusted to support the patient in the gynecological position.
Figure 3:
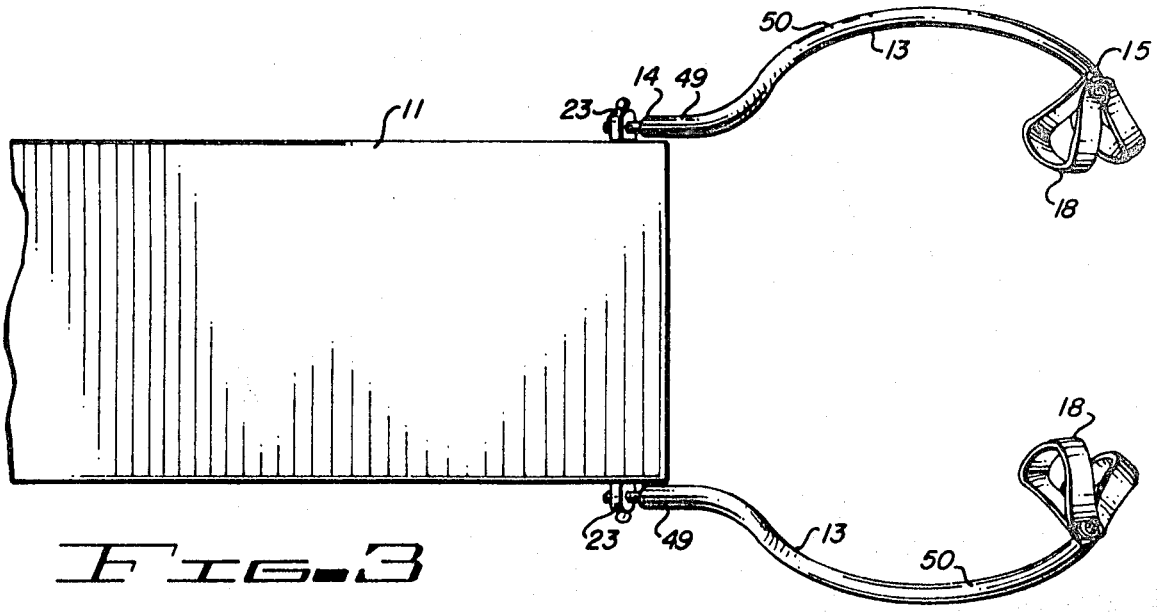
FIG. 3 is a partial plan view of a medical table having the stirrups of the instant invention attached thereto.
Figure 4:
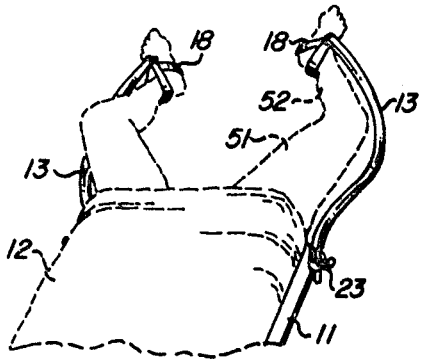
FIG. 4 is a partial perspective view further illustrating the stirrups of the instant invention in combination with the medical table.

With respect to FIGS. 1 and 3 which show the stirrups of the instant invention in elevational and plan view, respectively, and to FIG. 4 which further shows the stirrups in perspective it is seen that elongate shaft 13 has a first relatively short straight section 49 extending from first end 14 and an arcuate second section extending between straight section 49 and second end 15. In FIG. 1 the stirrups 10 are seen attached to medical table 11 and oriented to hold a patient 12 in an orthopedic prep position in which the legs are held in a spread position with upper leg 51 in a substantially vertical or slightly forward position while upper leg 52 is relatively horizontal. The position of patient 12 in FIG. 2 is generally representative of the gynecological position in which upper leg 51 forms an acute angle with the body and lower leg 52 is angled slightly upward. FIG. 4 resembles the position for laporotomy in which upper leg 51 is in relatively low angle with the horizontal and lower leg 52 is directed slightly downward. In the foregoing positions it is noted that arcuate section 50 of elongate shaft 13 is alternately positioned generally upward or downward in accordance with the type of support desired. In either case, however, elongate shaft 13 is rotated such that arcuate section 50 is generally curved away from the patient's leg.

The curvature of elongate shaft 13 is for the express purpose of eliminating contact between the patient's leg and the member by which it is supported.

Elimination of contact between the patient's leg and the support device is particularly significant since it is a normal tendency with prior art devices for the suspended leg to rest against the support member either of its own weight or be pressed against the support member by the medical attendant. The normal length of time for a patient to be so supported varies from approximately 30 minutes to approximately 3 hours. With prior art devices this results in leg bruises and temporary damage to the sciatic nerve which may trouble the patient for several weeks thereafter. Further patient comfort is provided by the moderately flexible shaft which restrains the patient's movement rather than confining the legs in a rigid position. This permits minor adjustment by the patient for comfort without interfering with the medical or surgical procedure. Similarly, the non-conductive elongate shaft eliminates accidental leg burns during electrical surgical procedures should the patient's leg accidentally come in contact with the stirrup.

Figure 8:
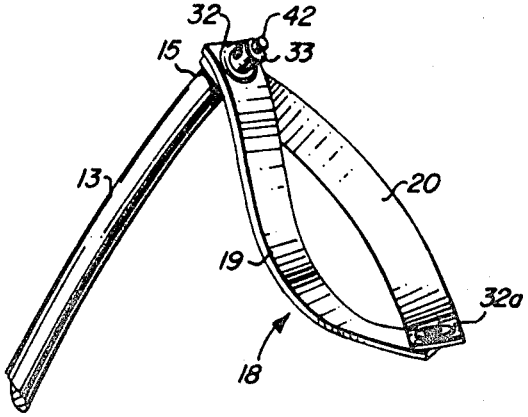
FIG. 8 is a partial perspective view of a stirrup of the instant invention as it would appear prior to receiving a patient's foot.

Further details of foot receiving means 18 are best described with reference to FIGS. 8, 9 and 10. In accordance with a preferred embodiment of the instant invention straps 19 and 20 are flat resilient strips of a canvas type material. The respective ends of straps 19 and 20 are adjoined as by sewing to have an angle therebetween. This induces a permanent curvature to each strap 19 and 20 such that the center line of each strap is generally arcuate relative the center line of the other strap. As previously noted eyes 32 and 32A pass through and are secured to respective ends of the adjoined straps.

In preparation for use elongate shaft 13 is secured to medical table 11 with curved section 50 properly oriented in accordance with the designated medical procedure as hereinbefore described. Foot receiving means 18 is secured to second end 15 by one of said eyes, herein specifically illustrated as eye 32, as also previously described. Due to the novel manner of attaching strap 19 to strap 20 foot receiving means 18 hangs from shaft 13 in a normal position as specifically illustrated in FIG. 8. In this position the free end of foot receiving means 18 extends away from shaft 13 and a permanent space is created between straps 19 and 20.

Figure 9:
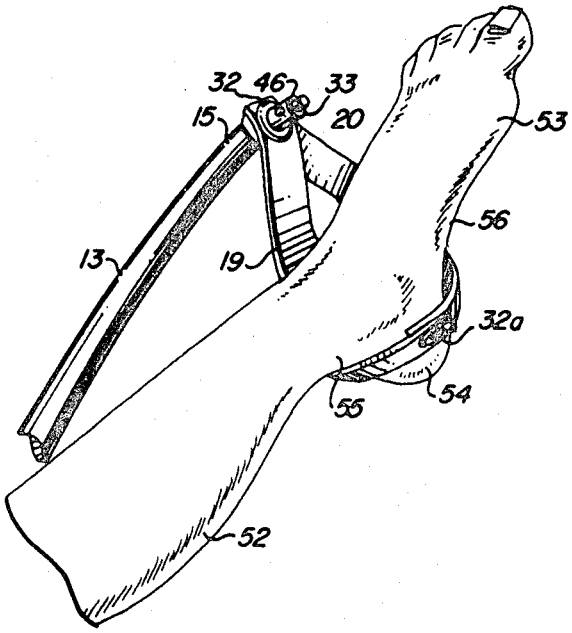
FIG. 9 is a view corresponding to the view of FIG. 8 as it would subsequently appear when having a patient's foot loosely received therein.
Figure 10:
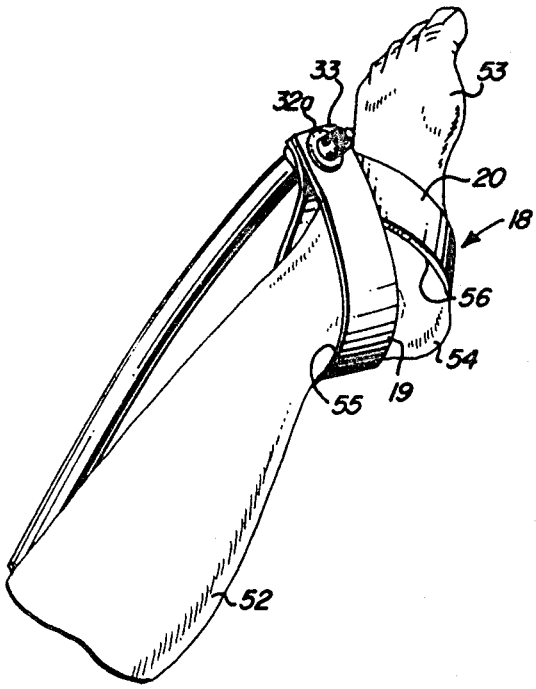
FIG. 10 is a view corresponding to the view of FIG. 9 as it would subsequently appear when the patient's foot is secured therein.

When the patient's foot 53, as is illustrated in FIG. 9, is placed in foot receiving means 18 heel 54 passes through the opening between straps 19 and 20 with strap 19 passing under the backside of ankle 55 and strap 20 extending across arch 56. In accordance with this arrangement foot 53 is suspended within foot receiving means 18 even though eye 32A is not connected with terminal section 33. It is readily apparent, therefore, that a single medical attendant may simultaneously lift each of the patient's feet one with each hand, and place each foot in the respective foot receiving means. In accordance with preferred medical practice the patient's legs are raised and lowered simultaneously. Subsequently, the medical attendant can independently adjust each foot 53 within foot receiving means 18 as may be necessary and secure eye 32A to shaft 13 in accordance with the procedure previously described. To release the patient the medical attendant individually attends to removing each eye 32A from the respective shaft 13 and allowing each foot to be suspended as in FIG. 9. Subsequently, the attendant simultaneously removes both feet and lowers both legs to the medical table.

Figure 11:
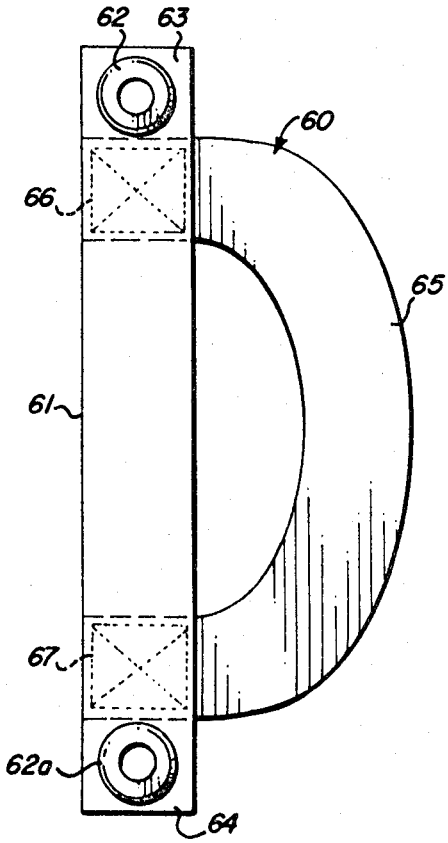
FIG. 11 is a plan view of an alternate embodiment of foot receiving means for use in connection with the instant invention.

Alternately preferred foot receiving means generally designated by the reference character 16 is seen in FIG. 11. First strap 61 includes eyes 62 and 62A proximate first and second ends 63 and 64, respectively. Second strap 65 is arcuate and terminates with first and second ends 66 and 67, respectively. First end 66 of second strap 65 is secured to first strap 61 proximate the first end 63 thereof. Similarly, second 67 of second strap 65 is secured to first strap 61 proximate second end 64 thereof. The center lines of straps 61 and 65 bear a relative arcuate relationship with a space therebetween for receiving the patient's heel and functioning similar to the previously described embodiment of foot receiving means 18.

In accordance with a further embodiment the foot receiving means may be fabricated from a single strap. When the ends of the strap are crossed and secured at approximately a 90° angle and provided with an eye 62 the device can be suspended from the upper end 15 of shaft 13 for receiving the foot as illustrated in FIG. 9. A second eye placed at the approximate mid-point of the strap is used as hereinbefore described for final securement of the foot.

Having fully described and disclosed the present invention and the preferred embodiments thereof in such clear and concise terms as to enable those skilled in the art to understand and practice the same, the invention claimed is:

1. A stirrup for use in combination with a medical table for engaging the foot of a patient and supporting the leg of the patient during certain medical procedures, said stirrup comprising:

a. an elongate shaft including, i. a first end adapted to be secured to said medical table, ii. a second end having connection receiving means; and b. foot receiving means including, i. a first elongate flexible strap having first and second ends, ii. a second elongate flexible strap having first and second ends secured to said first strap and having a centerline generally arcuate relative the centerline of said first strap, and iii. connection means proximate said first and second ends of said first strap and engageable with said connection receiving means of said shaft, whereby the heel of said foot is received and suspended between said first and said second straps when one of said connection means is engaged with said connection receiving means.

2. The stirrup of claim 1, wherein said elongate shaft is flexible yieldable in response to a force greater than the weight of the supported leg of the patient.

3. The stirrup of claim 1, wherein said connection means comprises an eye sized and shaped to pivotally receive said connection receiving means therethrough.

4. The stirrup of claim 3 further including detent means associated with said connection receiving means for selectively and operatively retaining said connection means.

5. The stirrup of claim 1, wherein said elongate shaft is electrically non-conductive.

* * * * *